US010398262B1

(12) United States Patent
Pheatt

(10) Patent No.: US 10,398,262 B1
(45) Date of Patent: Sep. 3, 2019

(54) SPONGE HANDLE SYSTEM

(71) Applicant: John Pheatt, Woodland, CA (US)

(72) Inventor: John Pheatt, Woodland, CA (US)

( * ) Notice: Subject to any disclaimer, the term of this patent is extended or adjusted under 35 U.S.C. 154(b) by 98 days.

(21) Appl. No.: 15/727,564

(22) Filed: Oct. 7, 2017

Related U.S. Application Data

(60) Provisional application No. 62/405,239, filed on Oct. 7, 2016.

(51) Int. Cl.
*A47K 7/02* (2006.01)
*A47L 13/46* (2006.01)
*A45F 5/00* (2006.01)

(52) U.S. Cl.
CPC ..... *A47K 7/028* (2013.01); *A47L 13/46* (2013.01); *A45F 2005/006* (2013.01)

(58) Field of Classification Search
CPC ..... A47K 7/028; A47K 7/03; A47L 13/46
See application file for complete search history.

(56) References Cited

U.S. PATENT DOCUMENTS

| | | | | |
|---|---|---|---|---|
| 6,276,022 | B1 * | 8/2001 | Gallacher | A47K 7/028 15/142 |
| 6,557,204 | B2 * | 5/2003 | Maxwell | A47K 7/028 15/210.1 |
| 8,312,586 | B2 * | 11/2012 | Chen | A46B 5/021 15/147.2 |
| 2003/0066152 | A1 * | 4/2003 | Nigh | A47K 7/028 15/209.1 |
| 2005/0005385 | A1 * | 1/2005 | Smith | A47K 7/028 15/231 |
| 2013/0205525 | A1 * | 8/2013 | Malloy | A47L 13/10 15/118 |
| 2015/0216371 | A1 * | 8/2015 | Cassiday | A47K 7/03 15/104.93 |

* cited by examiner

*Primary Examiner* — Randall E Chin
(74) *Attorney, Agent, or Firm* — Law Office of Michael O'Brien

(57) ABSTRACT

A sponge holding system includes a handle that is joined to a paraboloid having a central slot. An attachment fastener is joined to the handle. A sponge is arranged in the paraboloid. A lanyard is attached to the sponge, extending through the central slot, and connected to the attachment fastener. The lanyard holds the sponge in the paraboloid.

15 Claims, 11 Drawing Sheets

SPONGE HANDLE SYSTEM

RELATED APPLICATION

This application claims priority to provisional patent application U.S. Ser. No. 62/405,239 filed on Oct. 7, 2016, the entire contents of which is herein incorporated by reference.

BACKGROUND

The embodiments herein relate generally to personal accessories.

As used in this application, a "sponge" is a tool or cleaning aid consisting of soft, porous material. A "bath sponge" is such a sponge that a human would use while bathing. A "loofah" is a sponge formed from the fibrous skeleton of the sponge gourd (Luffa aegyptiaca, Cucurbitaceae). The loofah is typically sewn to a lanyard and can also be sewn to a pad. The loofah is readily available, cost-effective, and comes in a variety of shapes and sizes. A loofah can be a kind of bath sponge.

Prior to embodiments of the disclosed invention, the loofah was relatively limited in its application, as the user can only manipulate the loofah at an arms-length. Embodiments of the disclosed invention solve this problem

SUMMARY

A sponge holding system includes a handle that is joined to a paraboloid having a central slot. An attachment fastener is joined to the handle. A sponge is arranged in the paraboloid. A lanyard is attached to the sponge, extending through the central slot, and connected to the attachment fastener. The lanyard holds the sponge in the paraboloid.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
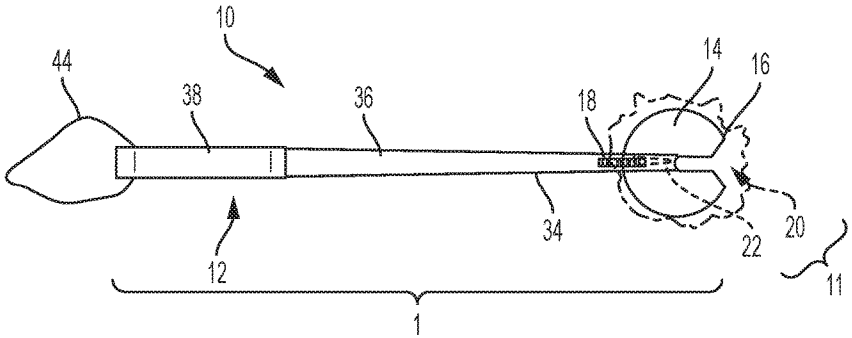
FIG. 1 shows a top view of one embodiment of the present invention.
Figure 2:
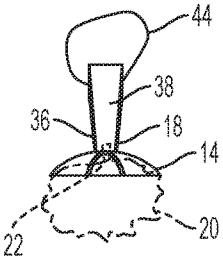
FIG. 2 shows a front view of one embodiment of the present invention.
Figure 3:
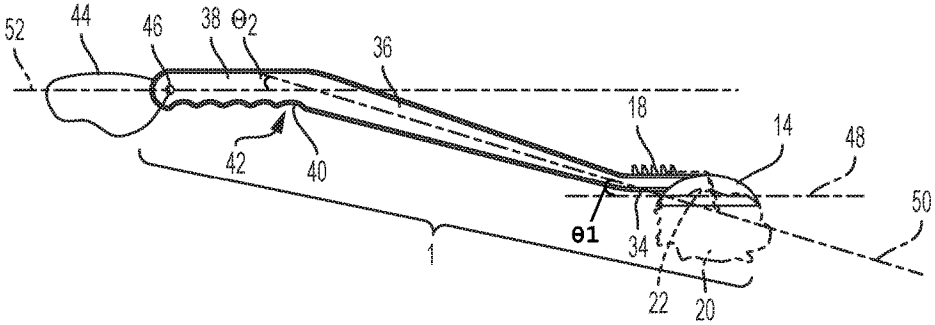
FIG. 3 shows a side view of one embodiment of the present invention.
Figure 4:
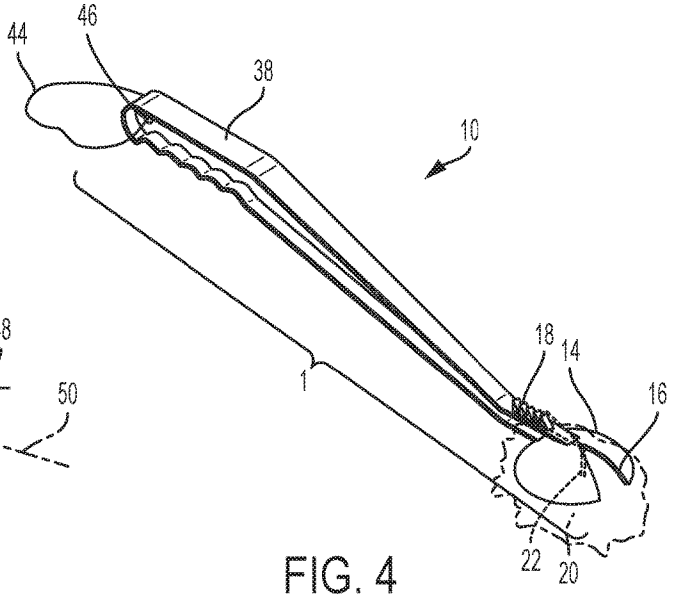
FIG. 4 shows a front perspective view of one embodiment of the present invention.
Figure 5:
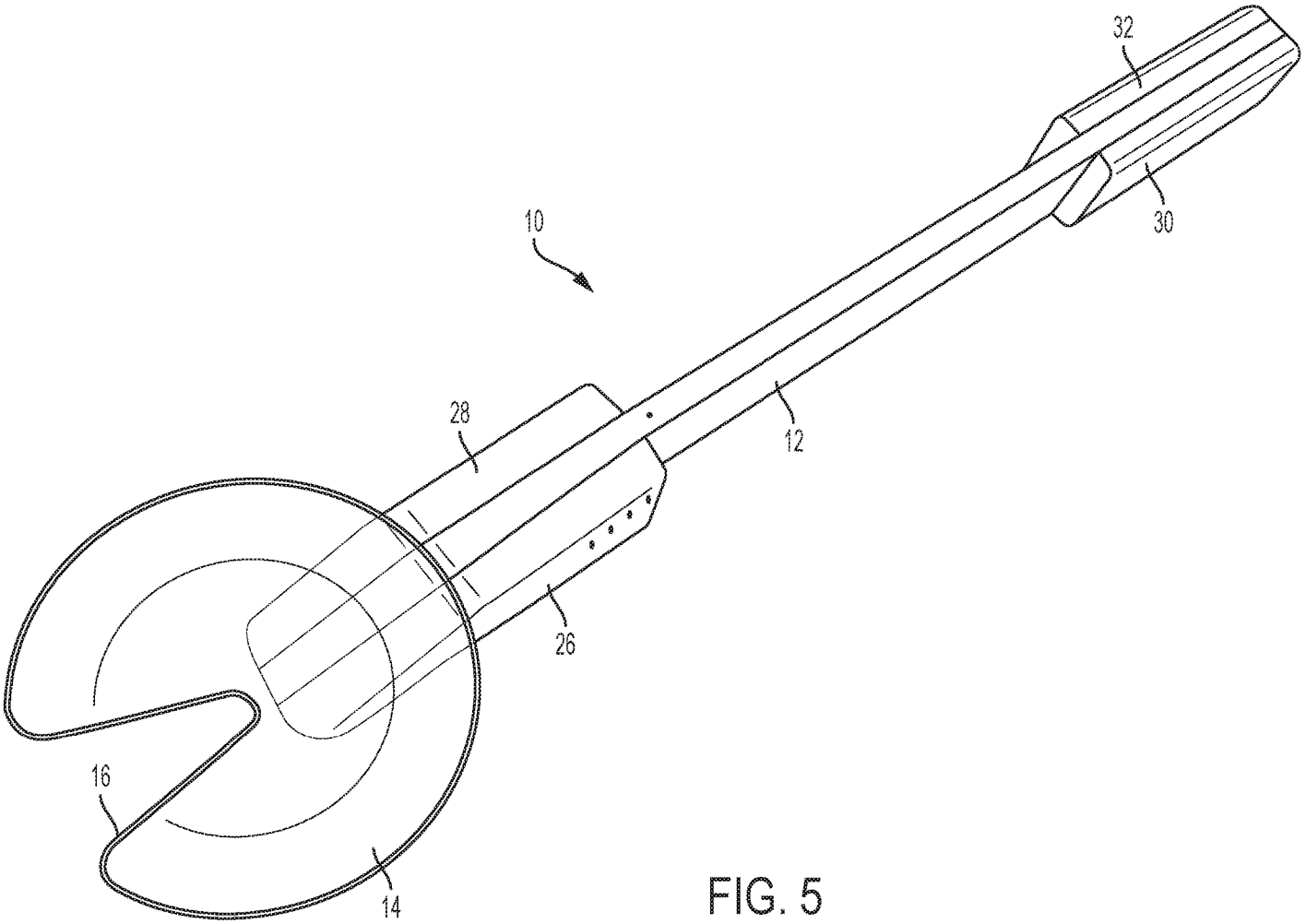
FIG. 5 shows a bottom view of one embodiment of the present invention.
Figure 6:
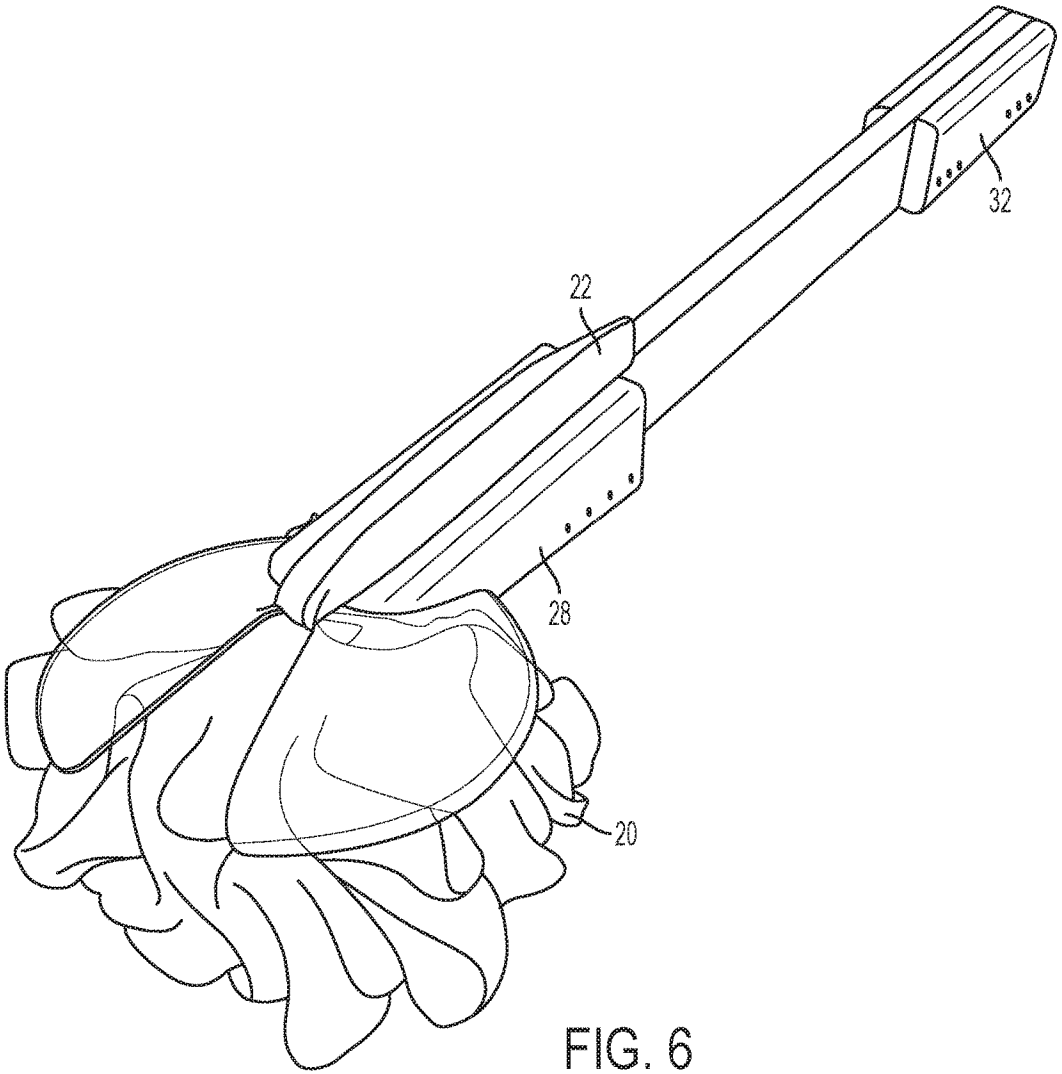
FIG. 6 shows a top perspective view of one embodiment of the present invention.
Figure 7:
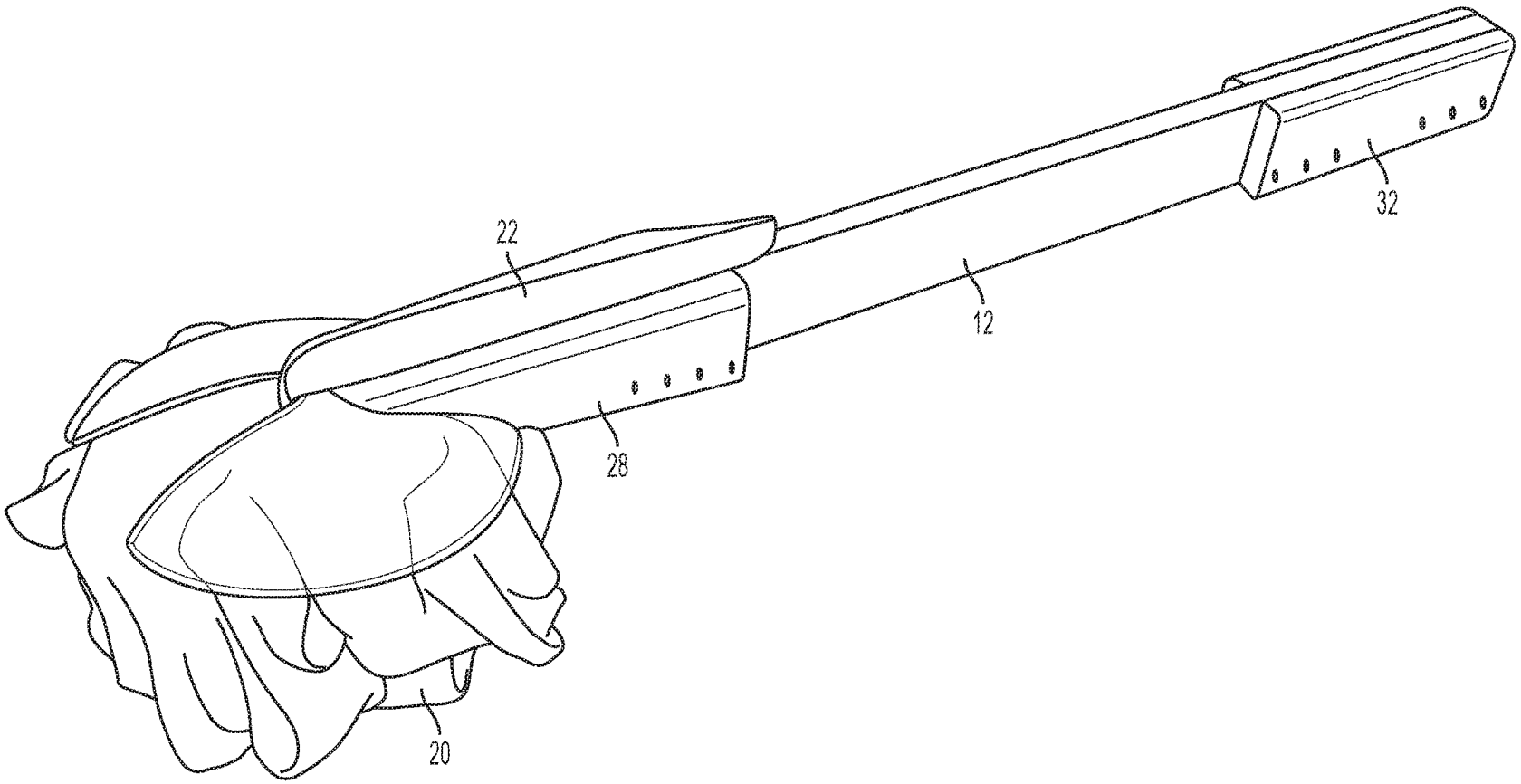
FIG. 7 shows a side perspective view of one embodiment of the present invention.
Figure 8:
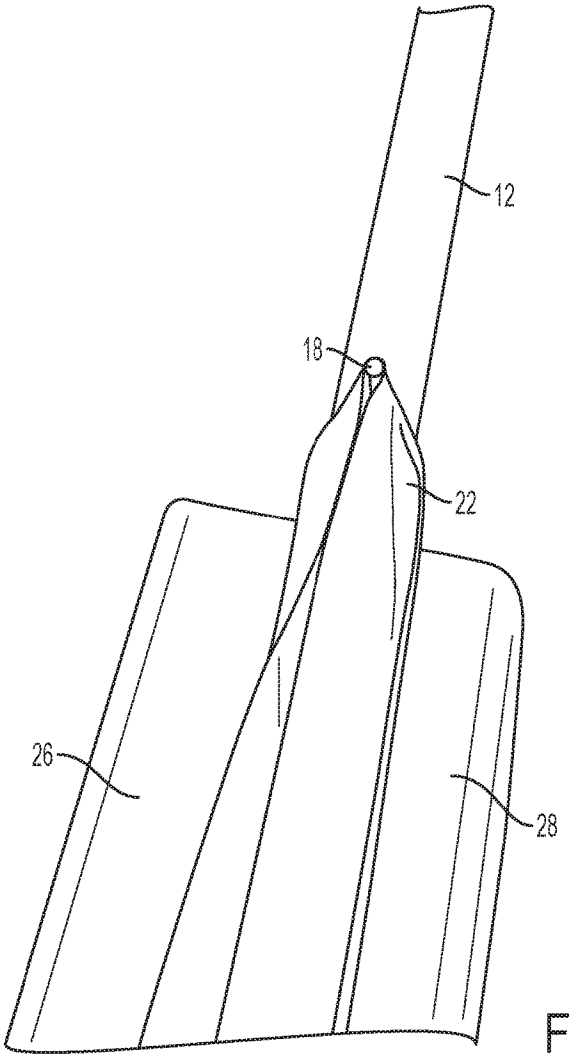
FIG. 8 shows a top detail view of one embodiment of the present invention.
Figure 9:
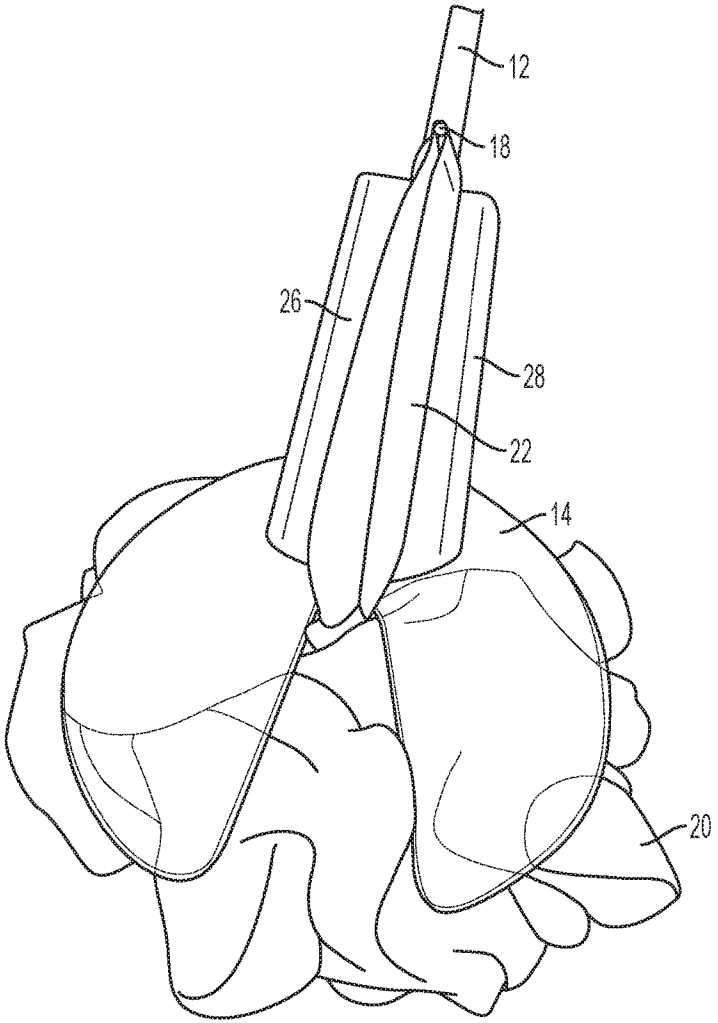
FIG. 9 shows a front detail view of one embodiment of the present invention.
Figure 10:
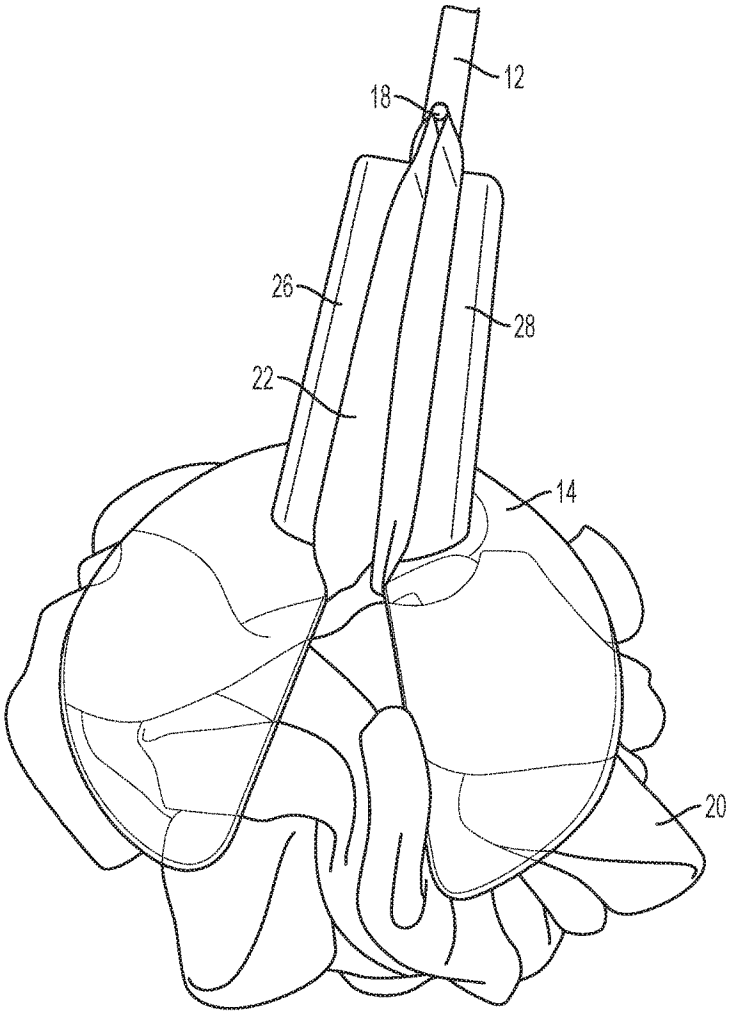
FIG. 10 shows a front detail view of one embodiment of the present invention.
Figure 11:
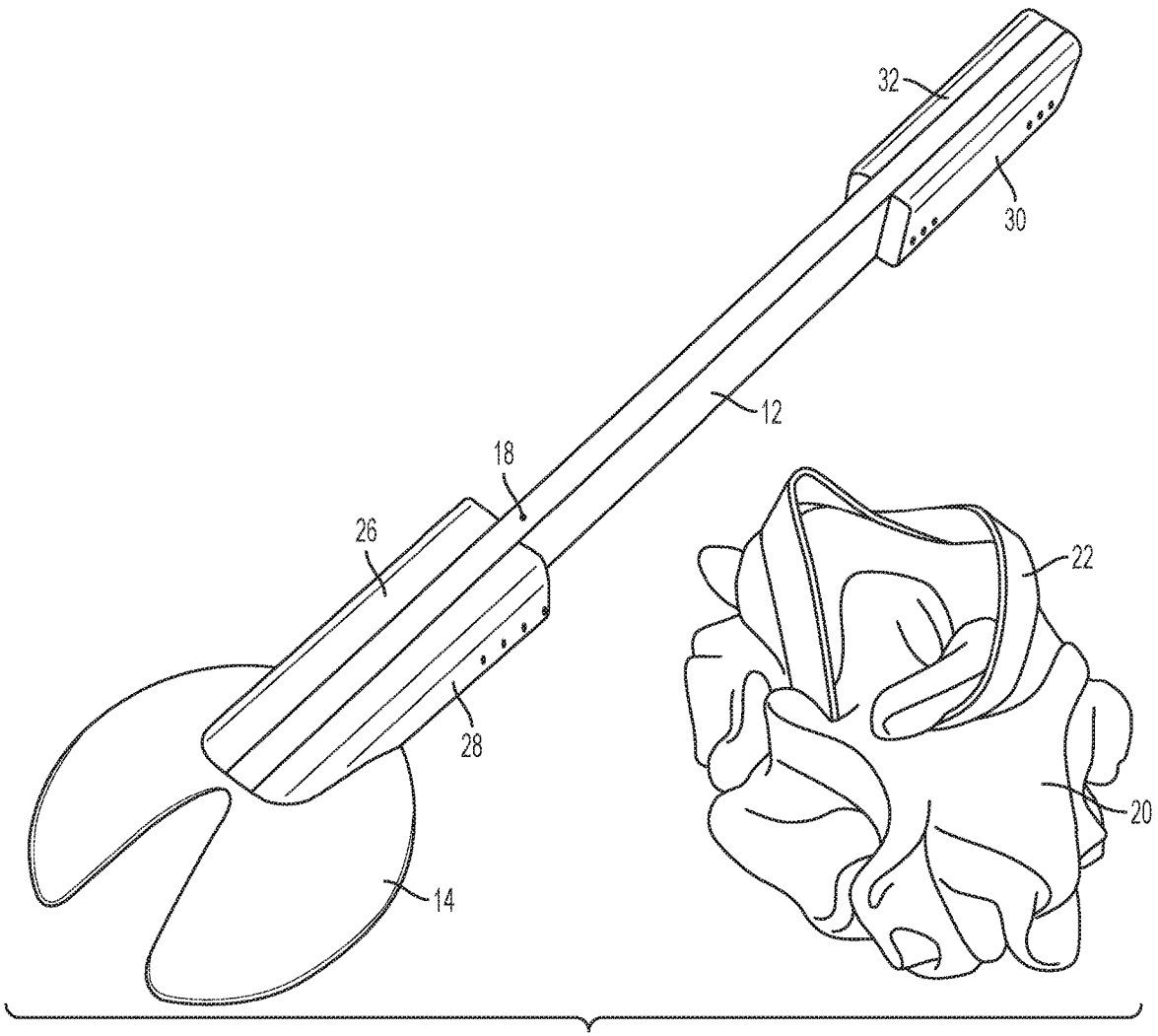
FIG. 11 shows a top detail view of one embodiment of the present invention in a disassembled configuration.
Figure 12:
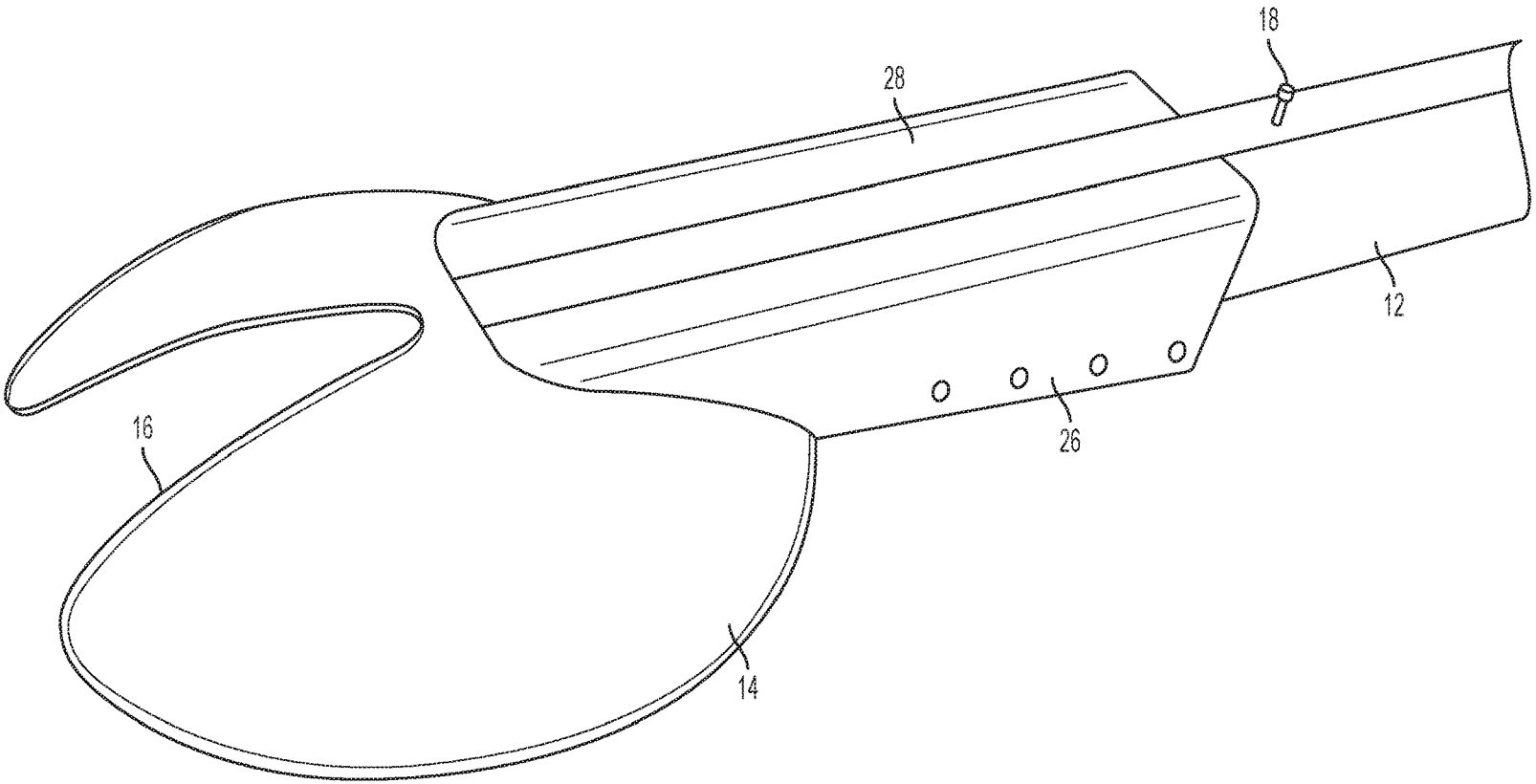
FIG. 12 shows a side perspective detail view of one embodiment of the present invention.
Figure 13:
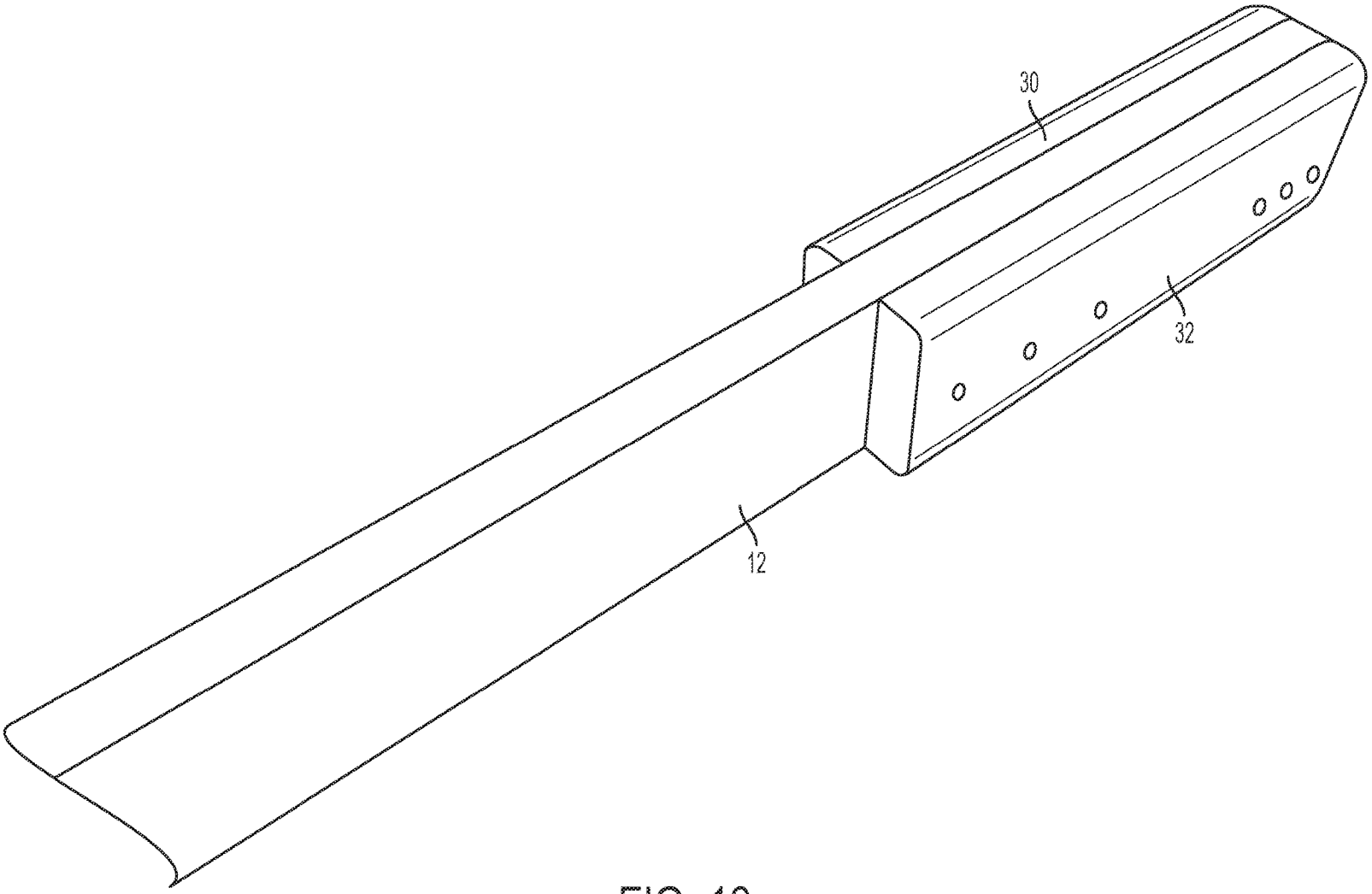
FIG. 13 shows a side perspective detail view of one embodiment of the present invention.
Figure 14:
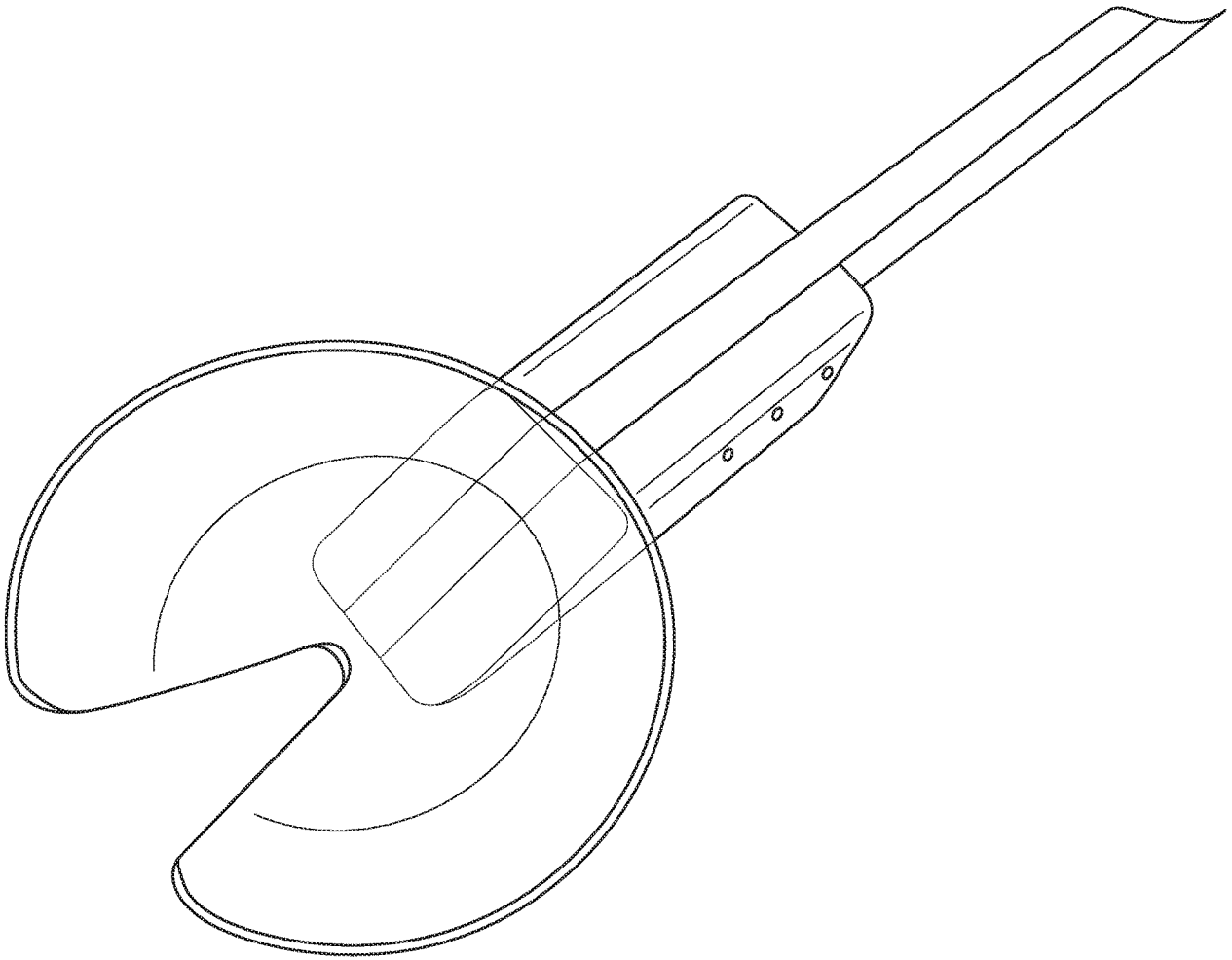
FIG. 14 shows a bottom detail view of one embodiment of the present invention.

By way of example, and referring to FIG. 1, one embodiment of a sponge holding system 10 includes a handle 12 that is joined to a paraboloid 14 having a central slot 16. An attachment fastener 18 is joined to the handle 12. In some embodiments, the attachment fastener 18 can be a plurality of fasteners such as a plurality of hooks. As used in this application a paraboloid is a quadric surface that has exactly one axis of symmetry and no center of symmetry. Here, the paraboloid 14 is an elliptic paraboloid that can be defined by the equation:

$$z = \frac{x^2}{a^2} + \frac{y^2}{b^2}$$

As noted, the paraboloid 14 has the central slot 16 arranged in a forward portion. The central slot 16 has a parabolic shape assuming that the surface of the elliptic paraboloid is defined as a plane.

A sponge 20 is arranged in the paraboloid 14. A lanyard 22 is attached to the sponge 20. The lanyard 22 extends through the central slot 16 and is connected to the attachment fastener 18. The lanyard 22 holds the sponge 20 in the paraboloid 14. The advantage of a plurality of fasteners is that various lanyards of different sizes can be accommodated. Further, it can be advantageous to twist the sponge 20 multiple times after the lanyard 22 is fastened to the attachment fastener 18 in order to wind up the lanyard 22 and further tighten retention and stability of the sponge 20.

In some embodiments, the handle 12 can be attached to a first side handle support 26 and a second side handle support 28. The first side handle support 26 and the second side handle support 28 can be further attached to the paraboloid 14. The handle 12 can be further attached to a first rear side handle support 30 and a second rear side handle support 32. The first rear side handle support 30 and a second rear side handle support 32 can be attached to the handle 12 distant the paraboloid 14.

In some embodiments, the handle 12 having a handle length 1 further comprises a proximal portion 34 joined to the paraboloid 14 proximate the central slot 16. The attachment fastener 18 is arranged on the proximal portion 34. An intermediate portion 36 can extend distally from the proximal portion 34 and having an increasing cross-sectional area while extending distally from the proximal portion 34. A distal portion 38 can extend distally from the intermediate portion 36. The distal portion 38 further comprises a finger grip portion 40 on an underside 42 of the distal portion 38. A lanyard 44 can be connected to a distal portion opening 46 arranged in the distal portion 38.

The proximal portion 34 is arranged on a proximal portion axis 48. The intermediate portion 36 is arranged on an intermediate portion axis 50. The distal portion 38 is arranged on a distal portion axis 52. The proximal portion axis 48 can be approximately parallel to the distal portion axis 52.

A first angle θ1 can be measured counterclockwise from the proximal portion axis 48 to the intermediate portion axis 50. A second angle θ2 can be measured counterclockwise from the distal portion axis 52 to the intermediate portion axis 50. The first angle θ1 can be approximately equal to the second angle θ2. The first angle θ1 can be at least 0 degrees but no more than 60 degrees.

Embodiments of this invention can be made of many different materials in many ways. For instance, woodworking can be used as well as injection molding and three-dimensional printing.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sponge holding system, comprising:
a handle, joined to a paraboloid having a central slot;
a plurality of hooks joined to the handle; wherein the plurality of hooks extend along one side of the handle away from the paraboloid;
a sponge, arranged in the paraboloid;
a lanyard, attached to the sponge, extending through the central slot, and connected to at least one of the plurality of hooks;
wherein the lanyard holds the sponge in the paraboloid.

2. The sponge holding system of claim 1, wherein the handle further comprises a first side handle support and a second side handle support, attached to the handle and the paraboloid.

3. The sponge holding system of claim 2, wherein the handle further comprises a first rear side handle support and a second rear side handle support, attached to the handle distant the paraboloid, the first side handle support and the second side handle support.

4. The sponge holding system of claim 1, wherein the handle further comprises a proximal portion joined to the paraboloid proximate the central slot wherein the plurality of hooks is arranged on the proximal portion.

5. The sponge holding system of claim 4, further comprising an intermediate portion extending distally from the proximal portion and having an increasing cross-sectional area while extending distally from the proximal portion.

6. The sponge holding system of claim 5, further comprising a distal portion extending distally from the intermediate portion and having a finger grip portion on an underside of the distal portion.

7. The sponge holding system of claim 6, further comprising a lanyard connected to a distal portion opening arranged in the distal portion.

8. The sponge holding system of claim 6,
wherein the proximal portion is arranged on a proximal portion axis;
wherein the intermediate portion is arranged on an intermediate portion axis;
wherein the distal portion is arranged on a distal portion axis; and
wherein the proximal portion axis is approximately parallel to the distal portion axis.

9. The sponge holding system of claim 8,
wherein a first angle is measured counterclockwise from the proximal portion axis to the intermediate portion axis;
wherein a second angle is measured counterclockwise from the distal portion axis to the intermediate portion axis;
wherein the first angle is approximately equal to the second angle.

10. The sponge holding system of claim 9, wherein the first angle is at least 30 degrees but no more than 60 degrees.

11. A sponge holding system, comprising:
a handle, joined to a paraboloid having a central slot; wherein the handle further comprises a first side handle support and a second side handle support, attached to the handle and the paraboloid
an attachment fastener joined to the handle;
a sponge, arranged in the paraboloid;
a lanyard, attached to the sponge, extending through the central slot, and connected to the attachment fastener;
wherein the lanyard holds the sponge in the paraboloid.

12. The sponge holding system of claim 11, wherein the handle further comprises a first rear side handle support and a second rear side handle support, attached to the handle distant the paraboloid, the first side handle support and the second side handle support.

13. A sponge holding system, comprising:
a handle, joined to a paraboloid having a central slot; wherein the handle further comprises a proximal portion joined to the paraboloid proximate the central slot; wherein the proximal portion is arranged on a proximal portion axis;
an intermediate portion extending distally from the proximal portion and having an increasing cross-sectional area while extending distally from the proximal portion; wherein the intermediate portion is arranged on an intermediate portion axis;

a distal portion extending distally from the intermediate portion and having a finger grip portion on an underside of the distal portion; wherein the distal portion is arranged on a distal portion axis; wherein the proximal portion axis is approximately parallel to the distal portion axis a distal portion extending distally from the intermediate portion and having a finger grip portion on an underside of the distal portion;

an attachment fastener joined to the handle; wherein the attachment fastener is arranged on the proximal portion;

a sponge, arranged in the paraboloid;

a lanyard, attached to the sponge, extending through the central slot, and connected to the attachment fastener;

wherein the lanyard holds the sponge in the paraboloid.

14. The sponge holding system of claim 13, wherein a first angle is measured counterclockwise from the proximal portion axis to the intermediate portion axis;

wherein a second angle is measured counterclockwise from the distal portion axis to the intermediate portion axis;

wherein the first angle is approximately equal to the second angle.

15. The sponge holding system of claim 14, wherein the first angle is at least 30 degrees but no more than 60 degrees.

* * * * *